US005265347A

United States Patent [19]

Woodson et al.

[11] Patent Number: 5,265,347

[45] Date of Patent: Nov. 30, 1993

[54] CENTRIFUGAL PELLET DRYER

[75] Inventors: William D. Woodson; Samuel F. Hannah, both of Eagle Rock, Va.

[73] Assignee: Gala Industries, Inc., Eagle Rock, Va.

[21] Appl. No.: 941,192

[22] Filed: Sep. 4, 1992

[51] Int. Cl.[5] ..... F26B 17/24

[52] U.S. Cl. ..... 34/58; 34/182

[58] Field of Search ..... 34/58, 8, 184, 182, 34/175, 33

[56] References Cited

U.S. PATENT DOCUMENTS

| | | | |
|---|---|---|---|
| 892,502 | 7/1908 | Coon . | |
| 2,727,631 | 12/1955 | Pate | 210/72 |
| 2,934,830 | 5/1960 | Zvejnieks | 34/32 |
| 3,385,443 | 5/1968 | Cuza | 210/178 |
| 3,458,045 | 7/1969 | Dudley | 210/95 |
| 4,156,392 | 5/1979 | Bayeh | 110/110 |
| 4,176,465 | 12/1979 | Murray et al. | 34/31 |
| 4,504,222 | 3/1985 | Christian | 432/139 |
| 4,565,015 | 1/1986 | Hundley | 34/58 X |
| 4,896,435 | 1/1990 | Spangler, Jr. | 34/58 |

*Primary Examiner*—Henry A. Bennet

*Attorney, Agent, or Firm*—Jacobson, Price, Holman & Stern

[57] ABSTRACT

A centrifugal pellet dryer in which centrifugal action is used to separate water from polymer pellets incorporating unique structural and functional features including but not limited to utilizing the pellet outlet nozzle as an air inlet, feeding the pellet/water slurry upwardly from underneath the dryer directly into the lower end of the rotor of the dryer, providing a sloped bottom in the dryer to facilitate ease of cleaning, providing a hinged cylindrical screen encasing the rotor to enable the screen to be removed for easier cleaning, closing the top of the dryer and using the pellet outlet for the air inlet which will eliminate flat spots in the pellet outlet to make it easier to clean and eliminate cross contamination which occurred in previous dryers as pellets frequently ricocheted or bounced into the air inlet filter housing and later fell back into the dryer, providing large panel doors to facilitate cleaning and constructing the dryer housing with flat sides which provide more versatility in the location of connections and enabling the dryer housing to be of double wall construction for receiving insulation to reduce noise.

14 Claims, 3 Drawing Sheets 10
22
66
64
62

90
92
52
54
28
94
74
40
34
42
78
36
84
80
82
16
4
4
50
74
72
14
18
38
84
76
82
58
48
56
98
68
20
60
70
108
96

CENTRIFUGAL PELLET DRYER

BACKGROUND OF THE INVENTION

1. Field of the Invention

The present invention relates to centrifugal pellet dryers in which centrifugal action is used to separate water from polymer pellets incorporating unique structural and functional features including but not limited to utilizing the pellet outlet nozzle as an air inlet, feeding the pellet/water slurry upwardly from underneath the dryer directly into the lower end of the rotor of the dryer, providing a sloped bottom in the dryer to facilitate ease of cleaning, providing a hinged cylindrical screen encasing the rotor to enable the screen to be removed for easier cleaning, closing the top of the dryer and using the pellet outlet for the air inlet which will eliminate flat spots in the pellet outlet to make it easier to clean and eliminate cross contamination which occurred in previous dryers as pellets frequently ricocheted or bounced into the air inlet filter housing and later fell back into the dryer, providing large panel doors to facilitate cleaning and constructing the dryer housing with flat sides which provide more versatility in the location of connections and enabling the dryer housing to be of double wall construction for receiving insulation to reduce noise.

2. Description of the Prior Art

U.S. Pat. No. 3,458,045 issued to Vernon E. Dudley on Jul. 29, 1969 and assigned to the same assignee discloses a centrifugal pellet dryer for separating water from polymer pellets and drying the pellets. U.S. Pat. No. 4,896,435 issued to Melvin B. Spangler, Jr. on Jan. 30, 1990 and assigned to the same assignee also discloses a similar dryer with replaceable components and other improvements. Centrifugal pellet dryers of this type having an air inlet in the upper end portion, a slurry inlet and a pellet outlet for dried pellets together with a rotor and screen assembly have been manufactured and used for many years. In addition to the above two patents, other centrifugal dryer structures are known in the following patents.

U.S. Pat. No. 892,502
U.S. Pat. No. 2,934,830
U.S. Pat. No. 4,156,392
U.S. Pat. No. 4,176,465
U.S. Pat. No. 4,504,222
U.S. Pat. No. 3,385,443
U.S. Pat. No. 2,727,631

While the above mentioned patents disclose centrifugal dryers, they do not disclose the specific unique structural features and functional advantages incorporated into this invention as discussed in the preceding paragraph.

SUMMARY OF THE INVENTION

An object of the present invention is to provide a centrifugal pellet dryer including a vertically disposed rotor enclosed by a mesh member or screen within an outer housing with a bottom inlet feeding a slurry of water and pellets directly into the lower end of the rotor and a pellet outlet at the upper end of the rotor and housing for discharge of the dried pellets with the pellet outlet also forming an air inlet nozzle which eliminates flat spots to facilitate cleaning and eliminates cross contamination of different types or colors of pellets which sometimes ricochet into the conventional air inlet and become lodged therein temporarily and subsequently drop back into the pellets being dried which may be of a different type or color.

Another object of the invention is to provide a centrifugal pellet dryer in which the housing includes large doors to facilitate cleaning and the mesh member or screen is of hinged construction also to facilitate cleaning and removal or replacement.

A further object of the invention is to provide a centrifugal pellet dryer in accordance with the preceding objects in which the slurry of pellets and water is fed into the bottom of the dryer from underneath and directly into the lower end of the rotor with the dryer including a sloped bottom in the housing leading to a drain to facilitate drainage of water from the housing and also facilitating cleaning.

Still another object of the invention is to provide a centrifugal pellet dryer in which the housing includes large doors which are hinged to facilitate cleaning with the housing and doors being of double wall construction for receiving insulation to reduce the noise level of the centrifugal dryer during operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
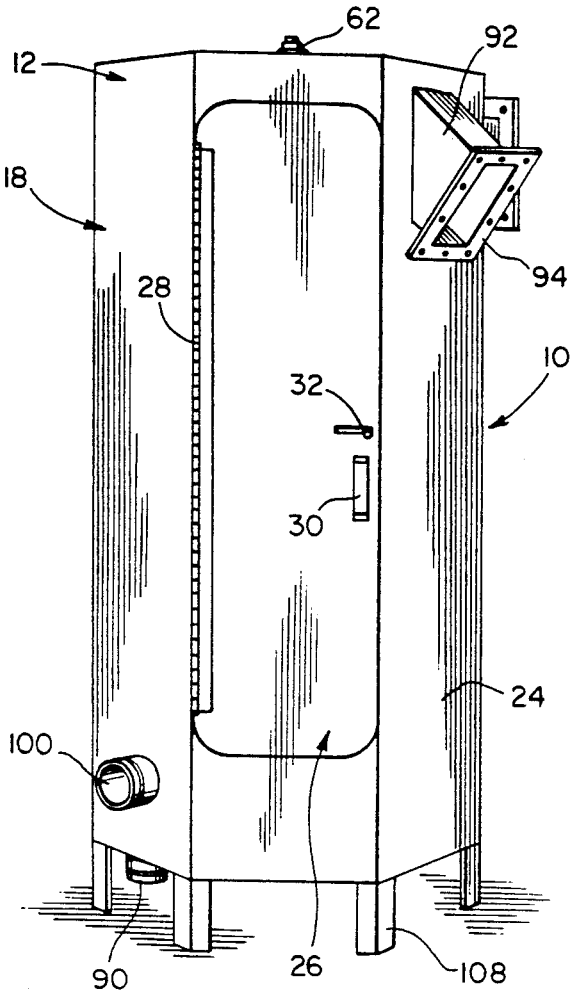
FIG. 1 is a perspective view of the centrifugal pellet dryer of the present invention.

The centrifugal pellet dryer of the present invention is designated by reference numeral 10 and is illustrated in its entirety in FIG. 1. The dryer includes an outer housing generally designated by reference numeral 12 which includes a cylindrical screen or foraminous member generally designated by reference numeral 14 with a rotor generally designated by reference numeral 16 being disposed within the screen 14.

Figure 2:
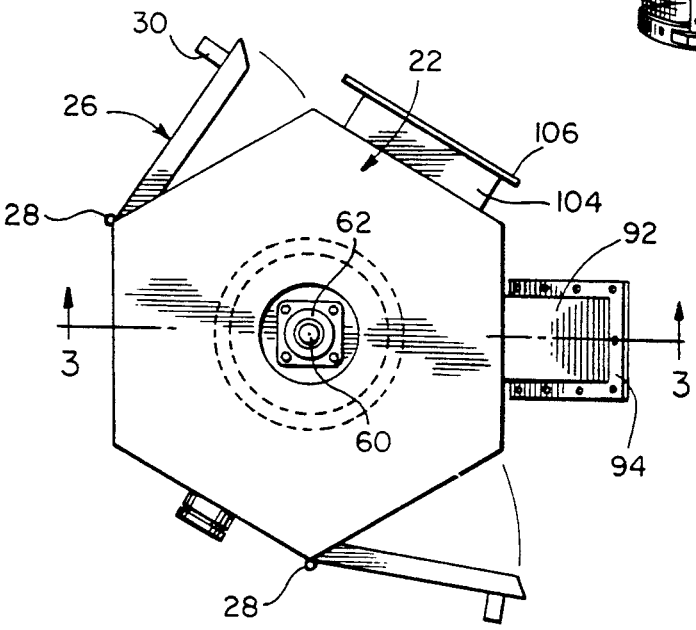
FIG. 2 is a top plan view thereof illustrating the doors moved partially toward an open position.
Figure 3:
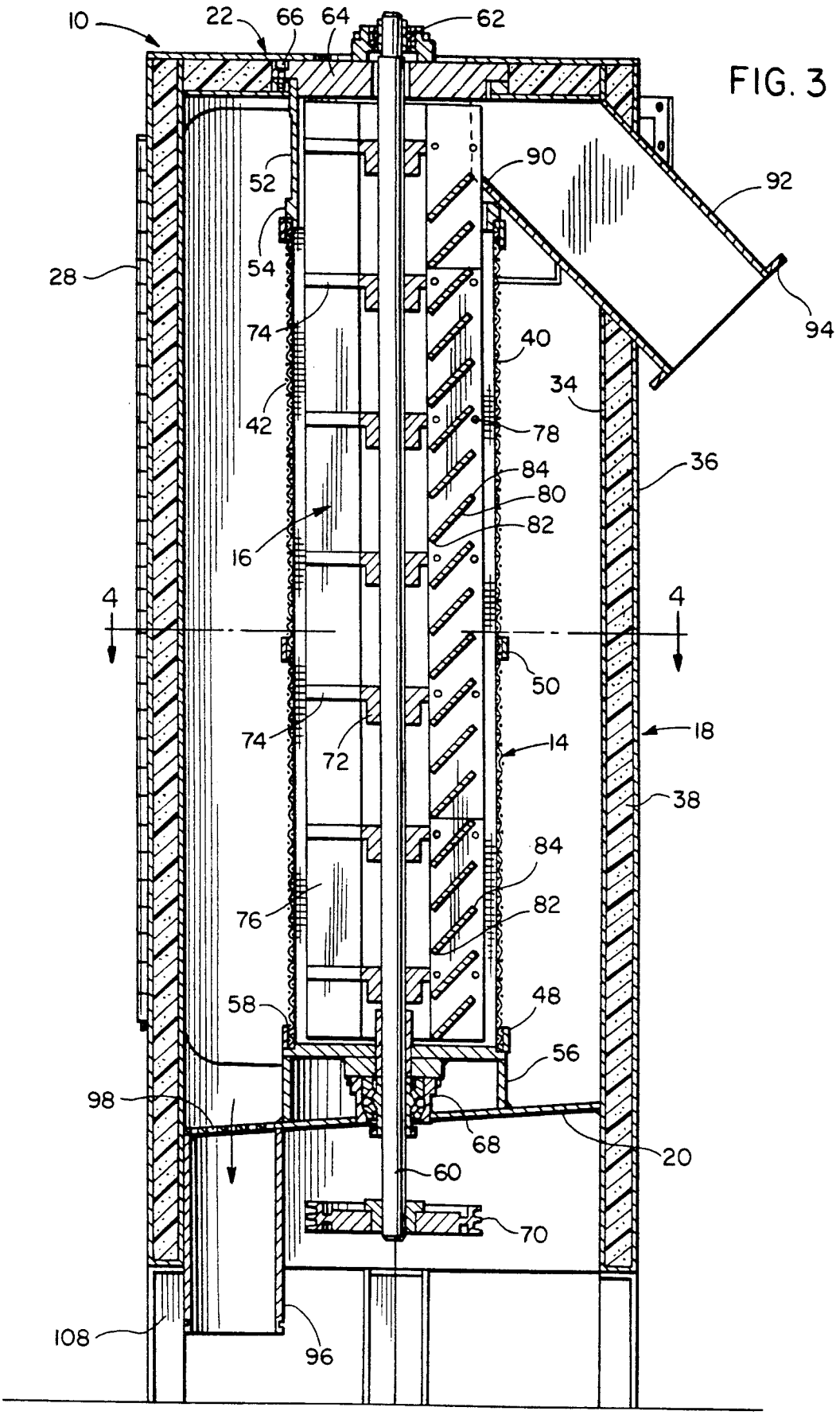
FIG. 3 is a vertical sectional view, on an enlarged scale, taken along section line 3—3 on FIG. 2 illustrating specific structural details of the dryer.
Figure 4:
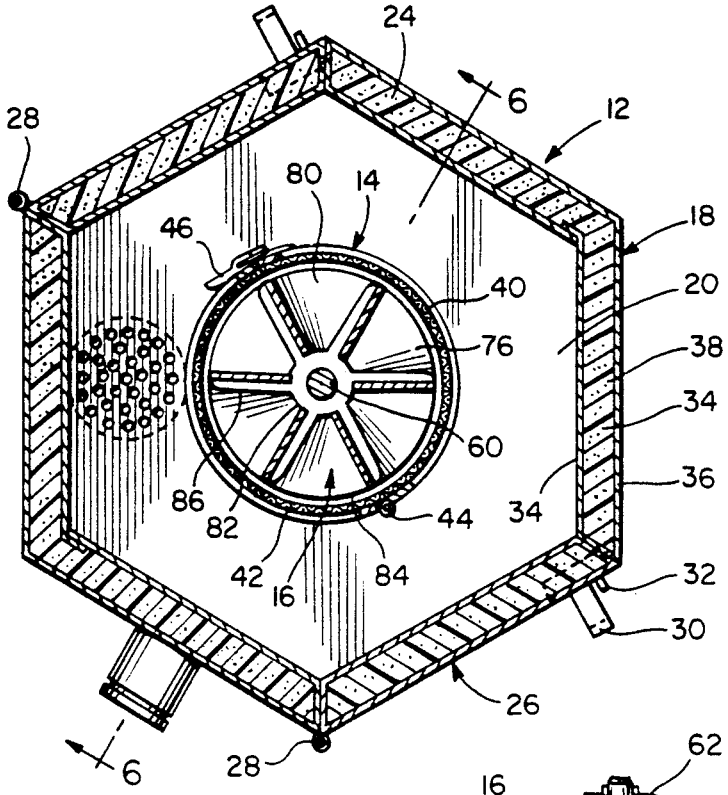
FIG. 4 is a transverse, plan sectional view taken substantially upon a plane passing along section line 4—4 on FIG. 3 illustrating further structural details of the dryer.

As illustrated in several figures of the drawings, the housing 12 includes a vertically disposed peripheral wall 18 closed at its bottom by a sloped bottom wall 20 positioned slightly above the bottom end of the peripheral wall 18. The upper end of the housing 10 is closed by a top wall generally designated by reference numeral 22. As illustrated in FIGS. 1, 2 and 4 the peripheral wall 18 includes a plurality of flat segments generally designated by reference numeral 24. The housing includes six side wall segments 24 with two of the opposed segments 24 being in the form of openable doors 26 supported at one vertical edge by a hinge structure 28 and provided with a handle 30 and latch structure 32 at the free edge to securely retain the doors in closed position and enable them to be opened when desired by releasing the latch structure 32 and swinging the doors outwardly as illustrated in FIG. 2. Each wall segment 24, each door 26 and the top wall 22 is of double wall construction including an inner panel 34 and an outer panel 36 spaced from each other with the space between the panels being filled by insulation material 38 such as foam plastic or any other suitable insulation material for the purpose of reducing noise produced by operation of the dryer. The doors 26 provide access to the interior of the housing to facilitate cleaning and also provides access to the screen 14.

Figure 7:
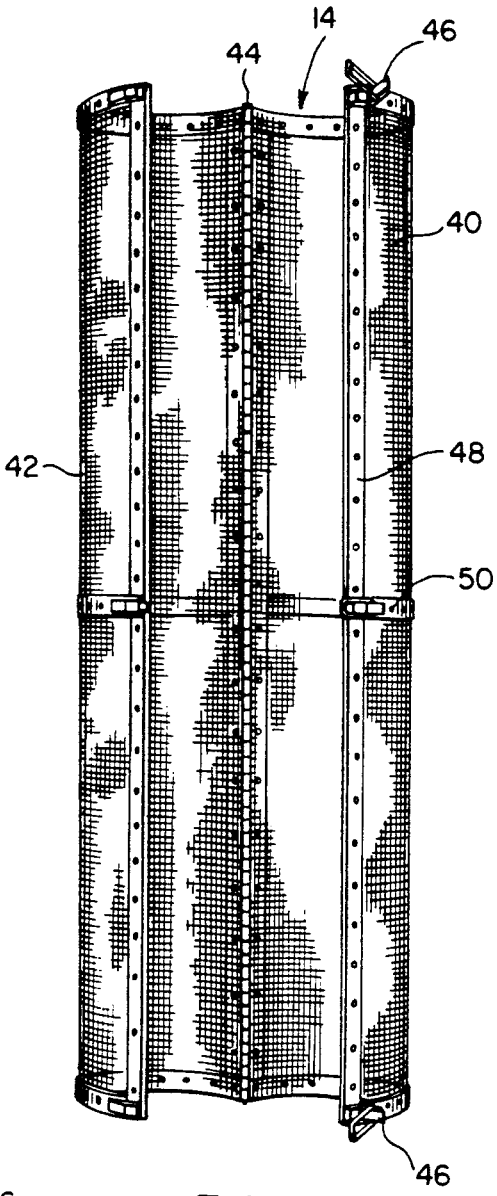
FIG. 7 is a perspective view of the screen illustrating the hinged construction thereof.
Figure 5:
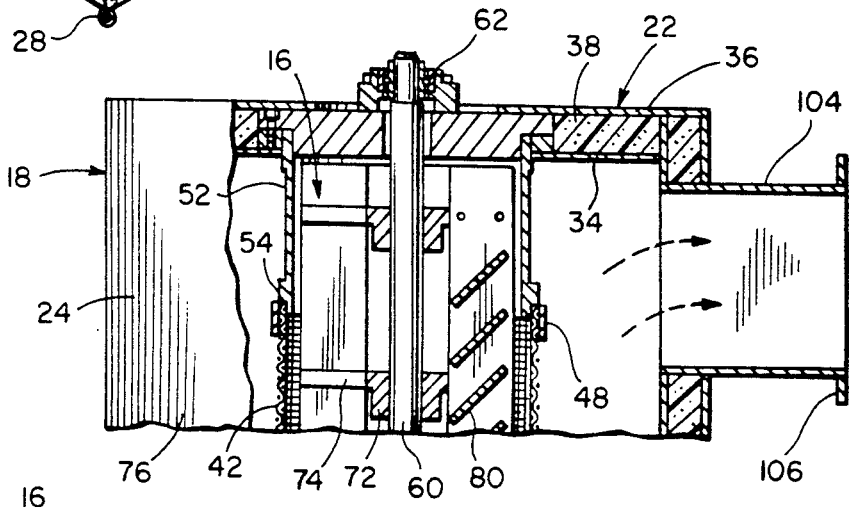
FIG. 5 is a fragmental sectional view of the upper end of the dryer illustrating the air exhaust duct.
Figure 6:
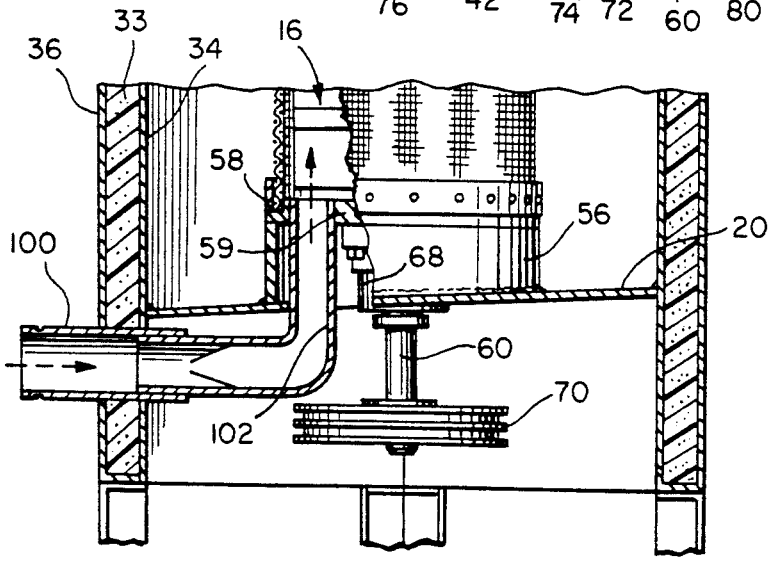
FIG. 6 is a fragmental sectional view taken along section line 6—6 of FIG. 4 illustrating the lower end of the rotor including the sloped bottom and slurry inlet.

As illustrated in FIGS. 2 and 7, the screen 14 includes a pair of semicylindrical components 40 and 42 hingedly connected at one edge by a vertical hinge structure 44 and connected at the other edge by quick acting, over center latches 46. As illustrated in FIG. 7, the screen components 40 and 42 are provided with peripheral edge frame members 48 as well as a central belt frame member 50 to maintain the shape and configuration and rigidity of the screen members 40 and 42. As illustrated in FIGS. 5 and 6, the top wall 22 is provided with a depending cylindrical member 52 affixed to the inner panel 34 and provided with a peripheral shoulder 54 in which the upper end edge of the screen 14 is received and seated. The bottom wall 20 includes a similar cylindrical member 56 having a seat or shoulder 58 on which the lower end of the screen is received and seated. This structure enables the screen 14 to be removed easily for cleaning and replacement when necessary by opening the doors 26 in the housing 12, releasing the latches 46 and opening the screen members 40 and 42 by pivoting them about hinge structure 44 in order to remove the screen 14 from the housing 12.

The rotor 16 includes a vertical shaft 60 extending vertically through the housing and through the bottom wall 20 and the top wall 22. The upper end of the shaft is supported by a bearing and retaining structure 62 supported by a mounting plate 64 secured to the top wall by fasteners 66. The lower end of the shaft 60 extends through the bottom wall 20 and includes a bearing and seal assembly 68 to prevent leakage of water from the interior of the housing downwardly along the shaft 60. A drive pulley arrangement 70 is attached to the bottom end of the shaft 60 for rotating the shaft by the use of a suitable electric motor and pulley arrangement or any other suitable motor for rotating the shaft and rotor at a predetermined speed.

Mounted in vertically spaced relation on the shaft 60 is a plurality of support hubs 72 with radially extending support arms 74 forming support spiders for a plurality of vertically disposed plates or blades 76 secured to the arms by fastening devices 78. Welded to and extending between the plates 76 is a plurality of blades 80 each of which incline radially from an inner edge 82 to an outer edge 84 located at a higher elevation than the inner edge 82. Also, the outer edge 84 of the blade is curved generally to correspond to the inner surface of the screen 14 as illustrated in FIG. 4. Each blade 80 also includes a leading edge 86 welded to plate 76 and a trailing edge 88 welded to an adjacent plate 76 and is located at a higher elevation than the leading edge thus forming a blade which inclines upwardly from the leading to the trailing edge thereby forming a generally spiral segmental flight for the rotor for moving the pellets vertically within the screen 14 and at the same time causing the water that may be mixed with the pellets to be centrifugally separated therefrom and discharged through the screen 14 while the pellets are moved upwardly by the rotor to an outlet 90 formed in the cylindrical member 52 that is communicated with a pellet outlet duct 92 which extends laterally through the peripheral wall 18 in a downwardly inclined direction and terminating in a flange 94 for connection with a discharge conduit. The pellet outlet duct 92 also forms an air inlet nozzle for inlet of drying air into the dryer with the pellets and incoming air moving in countercurrent directions for effective drying. It is pointed out that the inner panel 34 forming the top wall 36 forms a flat surface for the outlet 90 thereby eliminating areas which would enable pellets to become lodged in such as an air inlet that passes through the top wall thus rendering the device easier to clean and also eliminating cross contamination of different types or colors of pellets during difference drying procedures for different types or colors of pellets.

The bottom wall 20 includes a drain 96 in a lower portion of the inclined bottom wall 20 that may be provided with a screen 98 thereby assuring discharge of water through the drain 96 which may be connected to any suitable disposal facility.

A slurry inlet 100 is disposed at the bottom of the housing and extends radially inwardly to an inlet pipe 102 which extends upwardly through the bottom wall 20 and upwardly through a bottom plate 59 in the upper end of the cylindrical member 56 where it supports the bearing and seal assembly 68 as illustrated in FIG. 6 with the inlet pipe for the pellet/water slurry entering directly into the bottom of the rotor 16 inwardly of the screen 14.

The structure of the centrifugal pellet dryer of this invention solves a problem which occurs when processors in the plastic industry change colors and materials frequently which now occurs more often than in the past. One of the major concerns is the cleanability of the pellet dryer in order to remove all pellets and material of one color or type prior to introducing differently colored pellets or material into the dryer. The door structure, screen structure, and housing structure including the air inlet nozzle incorporated into the pellet outlet all coact to provide an easy to clean dryer. Another concern with previous dryers is the noise level produced by operation of the dryer. The wall constructions including the insulation between the inner and outer panels provides for reduction of noise to a safe level and to a level which will satisfy present regulations regarding noise levels in industrial plants.

The pellet dryer as disclosed utilizes centrifugal action to separate water from polymer pellets as previous pellet dryers have done. Drying air passes across as the pellets are carried upwardly in a spiral butt path until they are discharged from the pellet outlet. Unique in this construction is the inlet for the pellet/water slurry 100, 102 which extends underneath the dryer and upwardly directly into the lower end of the rotor 16. As soon as the slurry enters the lower end of the screen, water will be discharged through the screen by gravity and by centrifugal action into the interior of the housing and downwardly onto the sloped bottom 20 for flow by gravity through the drain 96. The sloped bottom 20 enables the bottom to be easily cleaned. The hinged screen facilitates cleaning of the screen and rotor by opening the doors 26 and removing the screen 14 by operating the latches or fasteners 46 and opening the screen for removal and replacement after cleaning. The top wall of the dryer which normally includes an air inlet communicating with the rotor has been completely closed with a flat inner panel 34 with inlet air now being drawn in through the pellet outlet 92 in countercurrent relation to the outgoing pellets to further dry the pellets and eliminate flat spots in the pellet outlet to make the device easier to clean. Also, the elimination of an air filter and air inlet in the top wall of the housing eliminates a structure which previously has provided a source of cross contamination inasmuch as the pellets frequently ricochet or bounce upwardly into the inlet air filter housing and then subsequently fall back into the dryer, sometimes even days later, which resulted in cross contamination and also created an area that was very difficult to effectively clean. By closing the top wall and bringing air in through the pellet outlet, these problems have been solved. The drying air is removed from the housing through an air exhaust duct 104 extending through the housing 12 at the upper end thereof with the duct terminating in a flange 106 for connection with an exhaust blower, fan, or the like. As illustrated in FIG. 2, the six sides of the housing provides versatile areas for installation of doors 26 and also versatile areas for installation of the pellet outlet duct 92 and the air exhaust duct 104. The large doors 26 facilitate cleaning of the interior of the housing and removal and cleaning of the screen when desired. The flat sided construction of the housing also facilitates the construction of the side wall segments 18 of double wall construction with the space between the inner and outer panels being filled with insulation thereby reducing the noise produced by operation of the dryer to a safe and satisfactory level.

The dimensional characteristics of the dryer may vary but typically, the height of the dryer may be on the order 7 or 8 feet and the transverse dimension about 3 feet. Any suitable support structure may be provided for the housing including depending supporting legs 108 which may be fixedly attached to the housing in any suitable manner and secured to a floor or other supporting surface in a conventional manner. A portion of the housing below the bottom wall 20 may be omitted to permit passage of drive belts or the drive pulley 70 may be oriented below the bottom edge of the peripheral wall with it being pointed out that the type of drive and the connection to the shaft may vary and is conventional along with the manner in which the exhaust duct is connected to an exhaust fan or blower and the slurry inlet and pellet outlet also could be assembled with respect to the housing in a conventional manner with the pellet outlet also forming an air inlet nozzle for incoming drying air.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

We claim:

1. A centrifugal pellet dryer comprising a vertically disposed housing, a vertically disposed foraminous member disposed in said housing, a rotor mounted vertically in the foraminous member, inlet means for a slurry of water and pellets communicating with the bottom of the rotor, means driving the rotor for conveying pellets upwardly in the foraminous member and discharging water through the foraminous member, a pellet outlet extending laterally from the upper end of the housing and communicating with the interior of the foraminous member for receiving pellets from the rotor and discharging them laterally of the housing, a drain for water in the bottom of the housing, an exhaust air duct communicating with the upper end of the housing and adopted to be communicated with an exhaust fan, said pellet outlet being in the form of a duct providing an air inlet nozzle for inlet of drying air into the upper end of the foraminous member for discharge through the air discharge duct with the inflowing air moving countercurrent to pellets moving outwardly in the pellet outlet, said housing including a plurality of peripherally arranged flat peripheral wall segments, said pellet outlet being oriented in one of said flat wall segments, said exhaust air duct being oriented in a flat wall segment with both the pellet outlet and exhaust air duct being oriented at the upper end of said housing with the exhaust air duct communicating with the interior of the housing and the pellet outlet and air inlet communicating only with the interior of the foraminous member, two opposed flat wall segments including an enlarged door pivotally supported for movement between a closed and open position to provide access to the interior of the housing for cleaning.

2. A centrifugal pellet dryer comprising a vertically disposed housing, a vertically disposed foraminous member disposed in said housing, a rotor mounted vertically in the foraminous member, inlet means for a slurry of water and pellets communicating with the bottom of the rotor, means driving the rotor for conveying pellets upwardly in the foraminous member and discharging water through the foraminous member, a pellet outlet extending laterally from the upper end of the housing and communicating with the interior of the foraminous member for receiving pellets from the rotor and discharging them laterally of the housing, a drain for water in the bottom of the housing, an exhaust air duct communicating with the upper end of the housing and adopted to be communicated with an exhaust fan, said pellet outlet being in the form of a duct providing an air inlet nozzle for inlet of drying air into the upper end of the foraminous member for discharge through the air discharge duct with the inflowing air moving countercurrent to pellets moving outwardly in the pellet outlet, said rotor including a vertically disposed shaft, a plurality of support arms rigid with the shaft and a plurality of segmental spirally inclined blades mounted on said arms for conveying pellets upwardly through the foraminous member with centrifugal force causing separation of water from the pellets with water being discharged through the foraminous member.

3. The dryer as defined in claim 1 wherein said housing includes a closed top wall having a flat inner surface forming a portion of the pellet outlet to facilitate cleaning of the outlet and eliminating areas in which pellets can become lodged for subsequent discharge back into the housing and rotor to prevent cross contamination of different types and colors of pellets.

4. The dryer as defined in claim 1 wherein said foraminous member is in the form of a generally cylindrical screen formed by a pair of semicylindrical screen members pivotally connected along one vertical edge thereof and releasable connected along the other vertical edge thereof to enable removal, cleaning and replacement of the screen through said doors.

5. The dryer as defined in claim 2 wherein said housing includes a flat bottom wall inclined from one side to the other of said housing, said drain means being communicated with a lower end portion of said bottom wall.

6. The dryer as defined in claim 2 wherein said housing is of double walled construction including an inner panel and an outer panel spaced concentrically, and insulation material filling the space between said panels to reduce the noise level due to operation of the dryer.

7. The dryer as defined in claim 2 wherein said housing includes a closed top wall having a flat inner surface forming a portion of the pellet outlet to facilitate cleaning of the outlet and eliminating areas in which pellets can become lodged for subsequent discharge back into the housing and rotor to prevent cross contamination of different types and colors of pellets.

8. The dryer as defined in claim 2 wherein said housing includes a plurality of peripherally arranged flat peripheral wall segments, said pellet outlet being oriented in one of said flat wall segments, said exhaust air duct being oriented in a flat wall segment with both the pellet outlet and exhaust air duct being oriented at the upper end of said housing with the exhaust air duct communicating with the interior of the housing and the pellet outlet and air inlet communicating only with the interior of the foraminous member.

9. The dryer as defined in claim 8 wherein at least one flat wall segment includes an enlarged door pivotally supported for movement between a closed and open position to provide access to the interior of the housing for cleaning.

10. In a pellet dryer including a vertical housing, a vertical cylindrical screen stationarily supported in said housing, a rotor mounted vertically in said screen, means rotatably driving said rotor, a water and pellet slurry inlet means at a lower portion of said housing and screen, said rotor including blade means for conveying pellets upwardly in the screen while discharging water through the screen, water drain means at a lower end of said housing, and air exhaust means at an upper end of said housing, the improvement comprising a downwardly inclined duct forming pellet outlet and air inlet means at an upper end of the housing and communicating with the interior of said screen whereby incoming air passes over pellets moving outwardly in the pellet outlet and air inlet means and incoming air passes over pellets in an upper end of the screen as air is exhausted to said air exhaust means, said housing including an air imperforate closed top wall having a flat inner surface forming a portion of the pellet outlet and air inlet means to facilitate cleaning thereof and eliminating areas in which pellets can become lodged for subsequent discharge back into the housing and rotor to prevent cross contamination of different types and colors of pellets, said air exhaust means including a laterally extending duct connected with and extending only to the interior surface of the housing in circumferential spaced relation to the pellet outlet and air inlet means.

11. The improvement as defined in claim 10 wherein said housing includes a flat bottom wall inclined from one side to the other of said housing, said drain means being communicated with a lower end portion of said bottom wall.

12. The dryer as defined in claim 1 wherein said housing includes a flat bottom wall inclined from one side to the other of said housing, said drain means being communicated with a lower end portion of said bottom wall.

13. The dryer as defined in claim 1 wherein said housing is of double walled construction including an inner panel and an outer panel spaced concentrically, and insulation material filling the space between said panels to reduce the noise level due to operation of the dryer.

14. The improvement as defined in claim 10 wherein said screen is constructed of two semi-cylindrical members, means hingedly connecting said members together along one side edge thereof, means releasably connecting the other side edge of said members to enable assembly and disassembly of the screen with respect to the rotor, said housing including access door means in a peripheral portion thereof to enable passage of said screen and access to the interior of the housing to facilitate clean out of pellets.

* * * * *